United States Patent [19]

Cary

[11] 4,389,828

[45] Jun. 28, 1983

[54] SUSPENDED CEILING SYSTEM WITH CROSSING CLIP

[75] Inventor: Lloyd H. Cary, Magnolia, Ark.

[73] Assignee: Howmet Aluminum Corp., New York, N.Y.

[21] Appl. No.: 158,797

[22] Filed: Jun. 12, 1980

[51] Int. Cl.[3] ..... E04C 2/42

[52] U.S. Cl. ..... 52/665; 52/726

[58] Field of Search ..... 52/665, 667, 726, 484

[56] References Cited

U.S. PATENT DOCUMENTS

| | | | |
|---|---|---|---|
| D. 248,013 | 5/1978 | Win . | |
| 2,990,921 | 7/1961 | Wilde | 189/36 |
| 3,015,375 | 1/1962 | Lickliter | 189/36 |
| 3,035,672 | 5/1962 | Tuten et al. | 52/484 X |
| 3,093,221 | 6/1963 | Purdy | 189/36 |
| 3,096,862 | 7/1963 | Purdy | 181/36 |
| 3,321,879 | 5/1967 | Purdy | 52/665 X |
| 3,333,387 | 8/1967 | Deakins | 52/484 X |
| 3,385,021 | 5/1968 | Nys | 52/665 |
| 3,590,546 | 7/1971 | Lambert | 52/457 |
| 3,677,589 | 7/1972 | Roles | 287/189 |
| 3,798,865 | 3/1974 | Curtis | 52/665 |
| 4,019,300 | 4/1977 | Sauer | 52/665 |
| 4,108,563 | 8/1978 | Brown et al. | 52/667 X |

OTHER PUBLICATIONS

Catalogue-Roblin Building Products-1980-(Including Flangeklamp System Introduced Earlier), pp. 1-8.

*Primary Examiner*—Carl D. Friedman

*Attorney, Agent, or Firm*—Thomas L. Cantrell; Joseph H. Schley; Stanley R. Moore

[57] ABSTRACT

This application discloses a connection system for promoting the construction of suspended ceiling systems. A clip arrangement is used whereby rail-to-clip-to-rail connections are readily accomplished from below grid access using horizontal translation to trigger positive, secure engagement. The clip is slidable into axial grooves presented at the end of that rail which is to be connected to another rail in accordance with the invention. A detent finger carried by the clip engages that rail during this insertion and prevents unintentional withdrawal of the clip from reception within these grooves. Non destructive disassembly is effected by intentionally disengaging this detent finger. Two rails are connected in this manner when the other end of the clip is attached to another rail. Further, the connection system is adaptable to connect rails both end to end and end to side. In addition, it often desired to connect the ends of two aligned rails to opposite sides of a rail set between them. The strength and rigidity of this latter configuration is enhanced by interaction between the respective clips to one another and to the rails involved.

9 Claims, 5 Drawing Figures

SUSPENDED CEILING SYSTEM WITH CROSSING CLIP

BACKGROUND

Currently the bulk of commercial office space is finished using suspended ceiling systems. In such systems rails are assembled into a ceiling grid which is suspended from major structural elements in order to form a framework into which ceiling fixtures are set. The rails making up the grid are flanged to form horizontal frames which support acoustical tiles or other ceiling fixtures. In this manner space is provided for ductwork and power lines between the superposing structural members and the suspended ceiling depending therefrom.

It is neither convenient nor necessary to directly suspend each rail member during grid assembly. Typically, primary or "main tee" rails are directly suspended from the structural members above during construction and secondary rails such as "cross tees" or "sub tees" are then connected to the suspended primary rails. These connections require sufficient strength to support ceiling tiles and other fixtures and preferably provide flush interior flanges to impart stability to the inset fixtures and flush exterior flanges for an aesthetically pleasing appearance.

In addition to requirements of strength and stability, the connection of rails into the grid system must allow for quick connections, ease of assembly, and preferably provide for nondestructive disassembly. The ease of assembly and disassembly is particularly critical in construction practices requiring tedious overhead operations. Prior practices are deficient in meeting these requirements as can be illustrated with a sampling of the prior art.

First consider the cross tee-to-main tee connection system disclosed in U.S. Pat. No. 3,798,865. This grid connection system uses a clip that extends from a substantially perpendicular base plate which is held within a pair of grooves against the web of the main tee. The base plate of this clip rotably inserts into grooves where the plate can be spot welded in place against the web and the grooves crimped on either side to further secure the position of the clip relative to the main tee. The free end of the clip extends outwardly from the base plate and main tee and it is to this extension that the cross tee is fastened. The use of a screw is illustrated in this patent to fasten the cross tee to the clip. The presence of lower flanges severely handicaps the performance of these installation procedures if attempted from any position below the grid; and further, even if this handicap is overcome, this assembly technique proves time consuming, requires relatively skilled labor, and requires a variety of tools for the assembly operation.

U.S. Pat. No. 3,093,221 discloses another main tee-to-cross tee connection system. Here hooks on the clip register into apertures through the web of the cross tee and a detent tab is brought into one of these apertures to prevent unhooking. A spring "nose" on the extended free end of the clip engages an aperture located in the web of the main tee. This arrangement uses two separate and vertically disposed apertures through the web of the main tee when cross tees are connected in coaxial alignment on either side of the main tee. Under this system each clip-to-main tee connection is independent and does not cooperate to increase either the strength or the stability of the joint. Finally, note that this arrangement is limited to main tee-to-cross tee connection as is not readily adaptable to main tee-to-main tee connection.

Compare the cooperation of the clips in U.S. Pat. No. 3,015,375. However, this system requires dissimilar clips which require dissimilar assembly operations. Further, neither of the cross tees is secure until both have been placed. Finally, this arrangement fails to provide for positive engagement and depends upon gravity to maintain the connection.

U.S. Pat. No. 2,990,921 shares this last defect as it has no positive engagement and similarily depends upon gravity to maintain the clip connection. This results in a less rigid and less stable grid.

U.S. Pat. No. 3,321,879 discloses another arrangement for connecting main tees-to-cross tees. This arrangement requires relatively extensive shaping of an end of the cross tees in order to establish a tongue. The tongue configuration allows a clip to be coaxially received onto the cross tee. A portion of the clip engages the base of the tongue to limit further insertion and a detent finger engages an aperture in the tongue to prevent withdrawal. The extended free end of the clip terminates with two detent fingers that engage the distal side of the web of the main tee once the clip is inserted through an aperture in that web. Again, coaxial attachment calls for vertically disposed cross tee-to-main-tee connections. Note the efforts that have been taken to prevent interference of the clips and rails in passing. However, this arrangement makes no attempt to promote stability and strength through interaction of the passing clips.

The systems discussed above are further representative in that none of those systems are readily adaptable to both cross tee-to-main tee and main tee-to-main tee connections. Few clip arrangements are. One current practice that does, however, possess this versitility is the use of clips which must be manipulated to project tabs through slots in each rail. The protruding ends of the tabs are bent down after insertion. Like most of the systems discussed above, this last method of grid assembly requires workmen to perform several operations that are difficult to perform over one's head, particularly where the operation requires reaching around the extended flanges of the rail. The alternative to overhead assembly is to further elevate the workman, beyond that height at which the suspended main tees can first be comfortably reached, to an elevation where the suspended rails are eye level or lower in relation to the average workman. However, this addition to platform elevation creates a significantly more hazardous and difficult working environment and requires increased exertion in each of the many platform relocations required. Further, a platform elevation that allows clip-to-rail connection at eye level or below is then too high for convenient installation of fixtures into that grid.

SUMMARY OF THE INVENTION

The present invention promotes construction of suspended ceiling systems by providing a clip arrangement that allows convenient rail-to-clip-to-rail connection with only below grid access. The rails are axially slid onto clips, receiving the clips into paired grooves adjacent the web of the rail. The configuration of the clips and receiving rails in the present invention allows this horizontal translation, alone, to trigger a positive engagement that secures the relative position of the clip to each individual rail, and thereby of the adjoining rail. No other assembly operation is required to connect the rails into a grid framework and none of the described operations require awkward manipulation above and behind the extended flange. In addition the engagement means is releasable to facilitate disassembly. This feature is a vast improvement over some prior practices of destructive disassembly, even though disassembly in accordance with the invention, unlike assembly, requires operations which reach around the flange.

The clips are substantially planar configurations of resilient sheet metal with a spring biased detent finger protruding laterally from at least one end of its face. The other end carries either a similar spring biased detent finger or some alternative means for securement to the other of two rails to be joined. While it is convenient that each end of the clip engage the adjoining rail using a detent finger, it is only crucial that one end of the clip be available for attachment by such means. Where only one end of the clip employs a detent finger, it is preferable that the other end of the clip be connected to the abutted rail before it is suspended. In this manner the benefits of the present invention are realized in facilitating overhead assembly though only one of two connections employs the invention.

Each abutting rail, that is each rail which is to be joined endwise to another rail within the grid, has grooves established adjacent the web of the rail into which the clip longitudinally inserts. The grooves hold the inserted clip adjacent that side of the vertical web of the abutting rail toward which the detent finger is biased. The spring biased detent finger automatically engages a retaining structure associated with the adjacent web of the abutting rail when the clip has been axially inserted to the depth of the assembly position. This engagement secures the clip against withdrawal from the abutting rail.

Nondestructive disassembly is effected by reaching around the lower flange to depress and thereby disengage the detent finger. The clip can then be easily withdrawn.

Two major types of rail joints are present in a typical grid framework, coaxial and angular joints. In the case where two rails are coaxially joined, each rail is simultaneously both an abutted and an abutting rail with respect to its adjoining rail and it is possible to connect each rail by means of the clip-to-abutting rail attachment described above.

Alternatively, where rails join at some angle other than in coaxial alignment, the detent finger and retainer arrangement must be somewhat modified on the abutted rail and a slot through the web of that rail forms a pair of grooves to cooperate with the detent finger in a manner similar that cooperation of a clip to the grooves in an abutting rail. Further, among angular joints there is a certain aesthetic appeal to the appearance of cross tees that are continuous across main tees within the grid. The joints in such a grid are most often set at right angles with each joint having cross tees forming coaxial pairs connected to opposite sides of a mutually abutted main tee. This coaxial alignment of cross tees abutting to and across a central abutted main tee requires further modification to prevent interference between clips piercing the web of the main tee. An arrangement whereby these clips cooperate to establish their individual cross tee to main tee connections is discussed in the detailed description of the preferred embodiment to follow.

As discussed above, detent finger and retainer arrangements need not be present at both ends of a clip in order to reap the benefits of the present invention. However, where detent fingers and retainer arrangements engage each of the connected rails, a tab projecting from the surface of the clip at a point between the opposing ends of the clip proves helpful. The tab should be positioned to engage the rail and, in doing so, limit the depth of clip insertion to that depth at which the detent finger first engages. A second clip-to-rail connection is more easily accomplished when the first such connection has been thus secured in each direction that the grooves allow displacement.

A BRIEF DESCRIPTION OF THE DRAWINGS

DETAILED DESCRIPTION OF THE DRAWINGS

Figure 1:
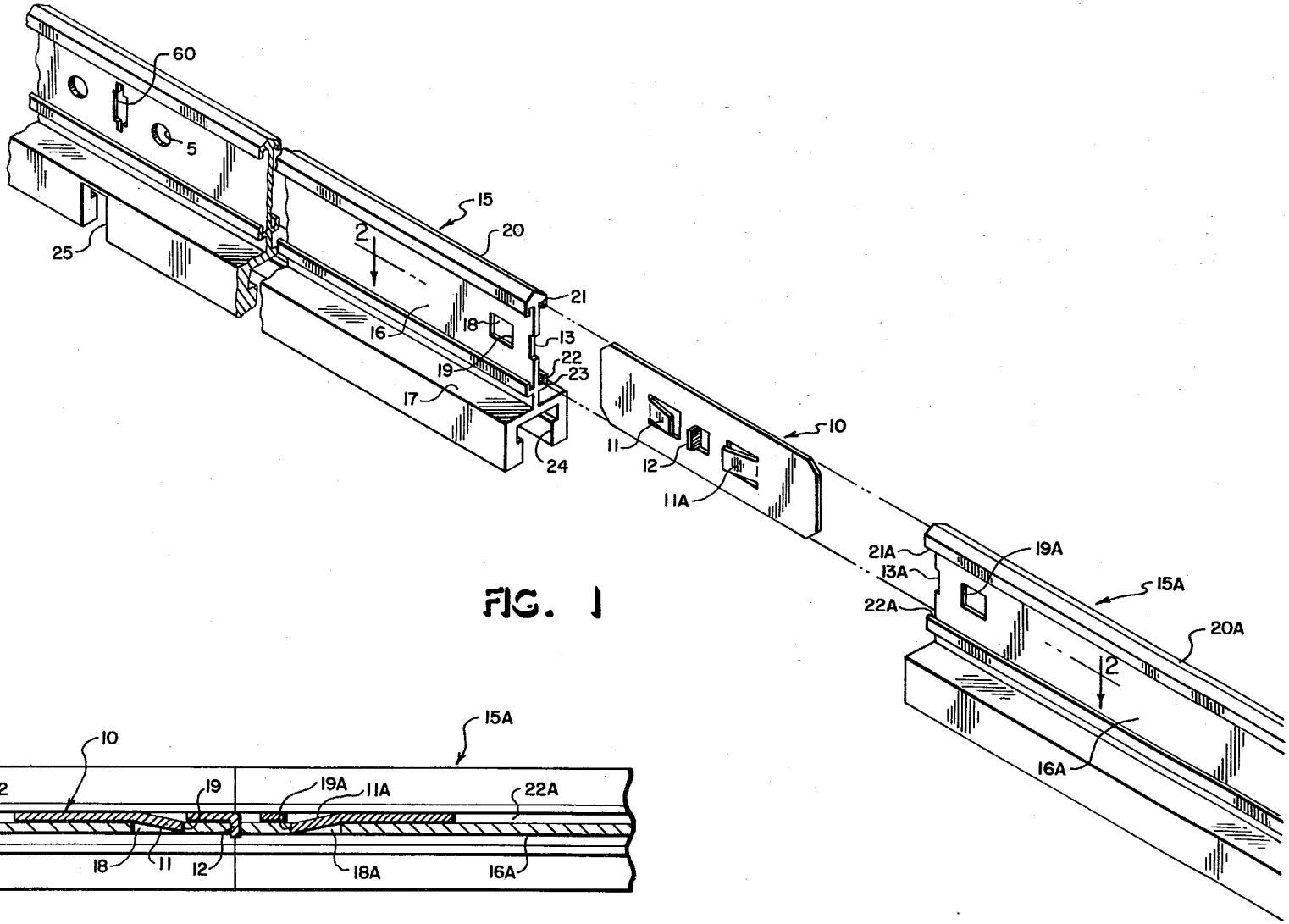
FIG. 1 is an exploded perspective view of a coaxial connection of ceiling grid elements in accordance with the present invention.

FIG. 1 illustrates a splice clip 10 suitable for joining mutually abutting rails 15 and 15A. This type of coaxial attachment is particularly useful for main tee-to-main tee connection establishing an integral connection of directly suspended main tees into an array of parallel rails into which array cross tees dependently attach.

Rail 15 is illustrated as such a main tee and provides for cross tee attachment (to be discussed later) at slit 60 and attachment of cables at holes 5 whereby the individual main tee and ultimately the entire ceiling is suspended from major structural members above.

Clip 10 is readily manufactured from resilient sheet metal into which a central tab 12 and detent fingers 11 and 11A on either end are cut and then bent outward.

Each illustrated rail is manufacturable using existing extrusion technology. The extruded rail, here 15, is then stamped or cut as necessary to form holes 5, slits 60 and retainer holes 18. Further, odd lengths are easily provided for at location without requiring extensive preparation of the cut end in order to receive a clip. The major elements of rail 15 are the lower flange 17 onto which ceiling tiles are set, a web 16 from which the lower flange depends and paired grooves 21 and 22 adjacent the web. The grooves 21 and 22 are either formed into flanges of the rail or are formed by channels otherwise established adjacent the web. The preferred embodiment illustrates upper groove 21 associated with an upper flange 20 and a lower groove 22 established by channel 23. Various aesthetic and functional additions to the rails may exist as illustrated by channels 24 and 25.

The end of rail 15A is the mirror image of the abutting end of rail 15 as described above. Further, in the preferred embodiment, cross sections of rail 15 and 15A are identical with bilateral symmetry that allows rails to be clipped from either side of the web for assembly. Thus rail 15A has its lower flange 17A, upper flange 20A, web 16A, upper groove 21A, lower groove 22A, and other features designated in an "A" series corresponding to those of rail 15.

During assembly clip 10 is slid into grooves 21 and 22 of rail 15 adjacent web 16 of that rail. The grooves hold a planar section of the clip adjacent the vertical web 16 of that rail by grasping the upper and lower edges of the clip. Further, the grooves serve to guide the insertion of clip 10 to ensure that detent finger 11 engages the retainer 19. In the preferred embodiment detent finger 11 is a cantilevered leaf spring protruding from the face of clip 10.

In the preferred embodiment a hole 18 is cut through web 16 of rail 15 in order to receive detent finger 11. Throughout the insertion of the clip, detent finger 11 is held adjacent the web against which it is biased. Once the detent finger aligns with hole 18, the detent finger springs into the hole where it engages retaining edge 19 to secure against the axial withdrawal of the clip from the rail. Note however, that disassembly can be deliberately and nondestructively effected by manually depressing detent finger 11 out of hole 18 and thereby disengaging the detent finger from retaining edge 19.

The addition of tab 12 to clip 10 further simplifies the connection of a second rail, 15A, to that end of clip 10 extending from the previously connected rail 15. The engagement of detent finger 11 prevents only the withdrawal of the clip from rail 15 and tab 12 is therefore useful because it engages rail 15 to limit the further insertion of clip 10 into rail 15.

Thus restricted by the grooves, engaged detent finger and tab, the clip is rigidly connected to rail 15 and the extended end of the clip is ready to receive rail 15A. A groove, detent finger and retainer arrangement receives rail 15A and prevents withdrawal of clip 10 just as the arrangement on the other end of the clip secured the clip to rail 15. This second connection utilizes grooves 21A and 22A, detent finger 11A and retaining edge 19A of hole 18A cut into web 16A. In this manner the two rails are secured to a mutual clip and, thereby, secured to each other.

Additional advantage may be gained by registering tab 12 into notches 13 and 13A of rail 15 and 15A, respectively. First, it is sometimes aesthetically objectionable that the rails be separated by the width of the tab and it is desired that the rails appear continuous across the connection. Second, the tab and notch configuration is structurally superior as the connection of rails that flushly abut across a substantial vertically disposed area, here the upper and lower flanges, offers additional resistance to bending moments. And finally, the use of identical recesses 13 and 13A which tightly fit about tab 12 allows the tab to serve as a key to further secure the connection against shear stress.

Figure 2:
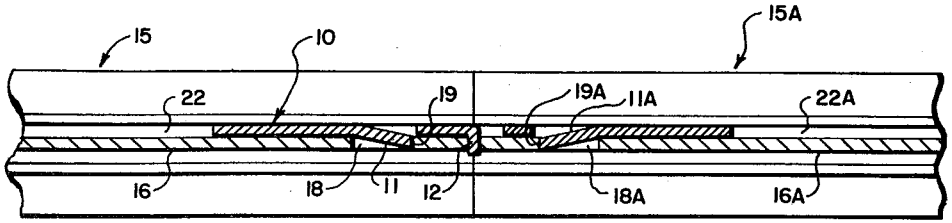
FIG. 2 is a cross section of the assembled elements of FIG. 1 taken along line 2—2 of FIG. 1.

FIG. 2 is a longitudinal sectioning of rails 15 and 15A which are connected by clip 10. The section passes through clip 10 and web 16 and 16A of connected rails 15 and 15A, respectively. The registration of detent fingers 11 and 11A from clip 10 into holes 18 and 18A is clearly illustrated. There the detent fingers engage retaining walls 19 and 19A, respectively, in order to connect rails 15 and 15A to one and another.

Figure 3:
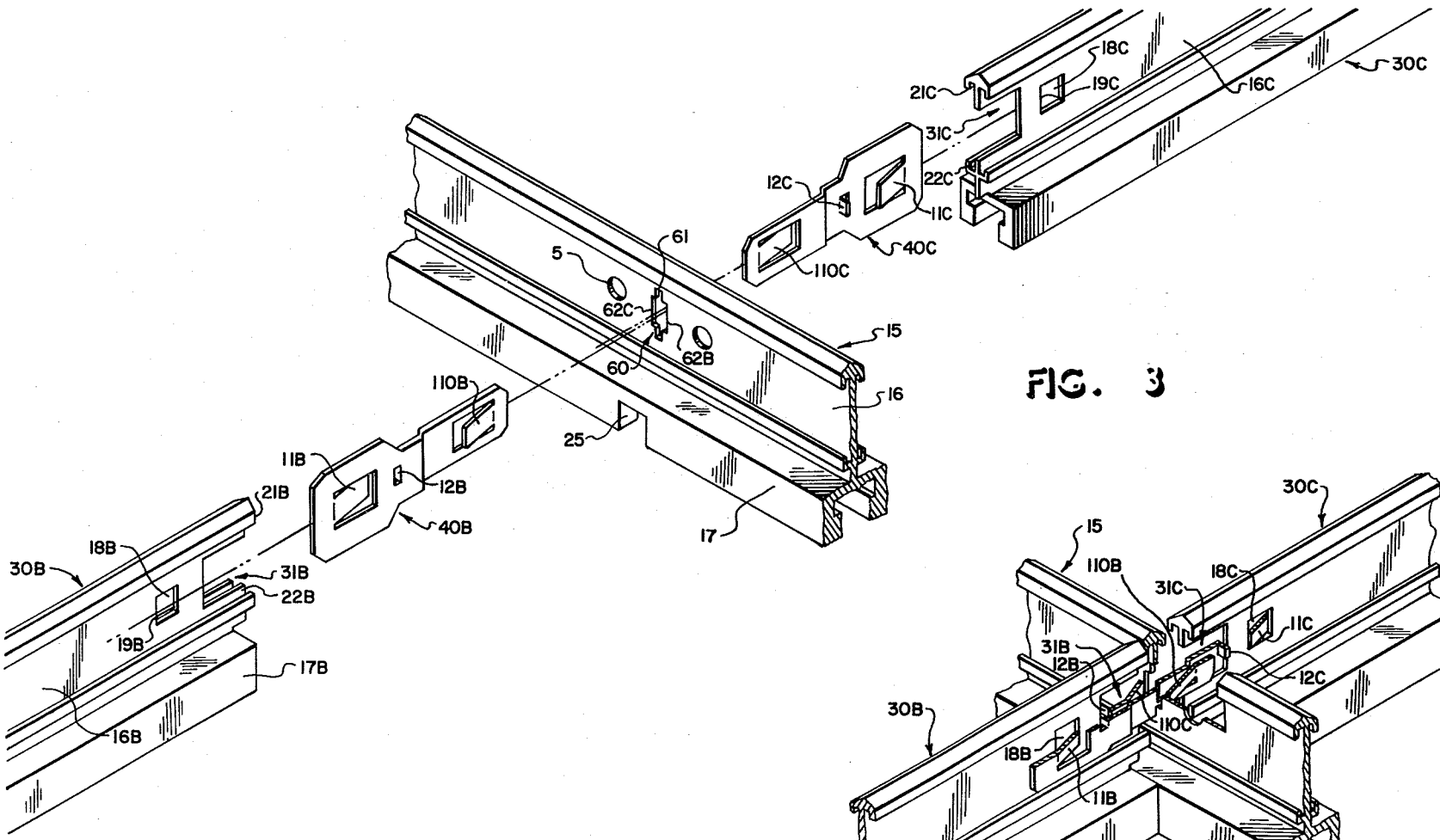
FIG. 3 is an exploded perspective view of cross tee-to-main tee connection in accordance with the present invention.
Figure 4:
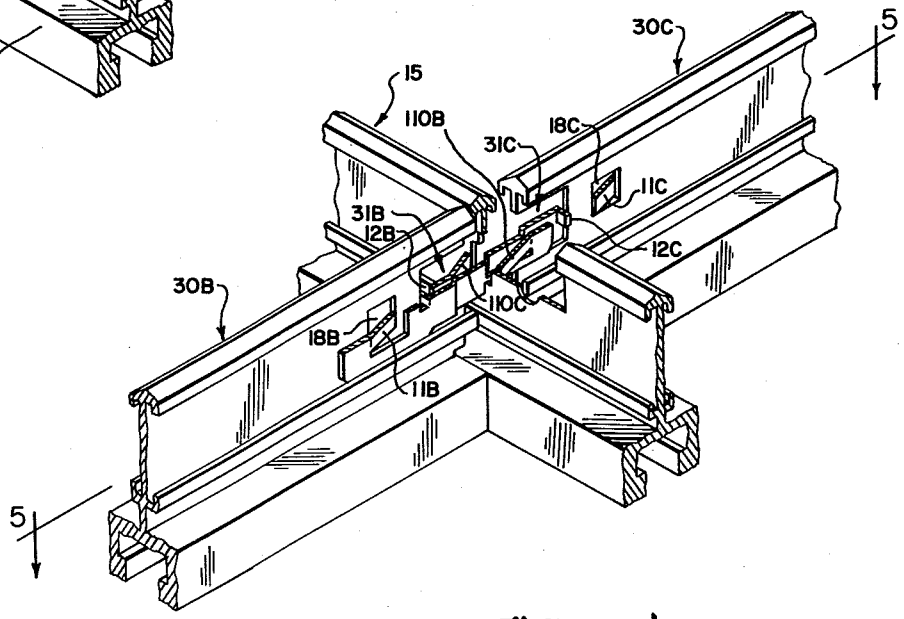
FIG. 4 is a cut away perspective view of an assembled cross tee-to-main tee connection.
Figure 5:
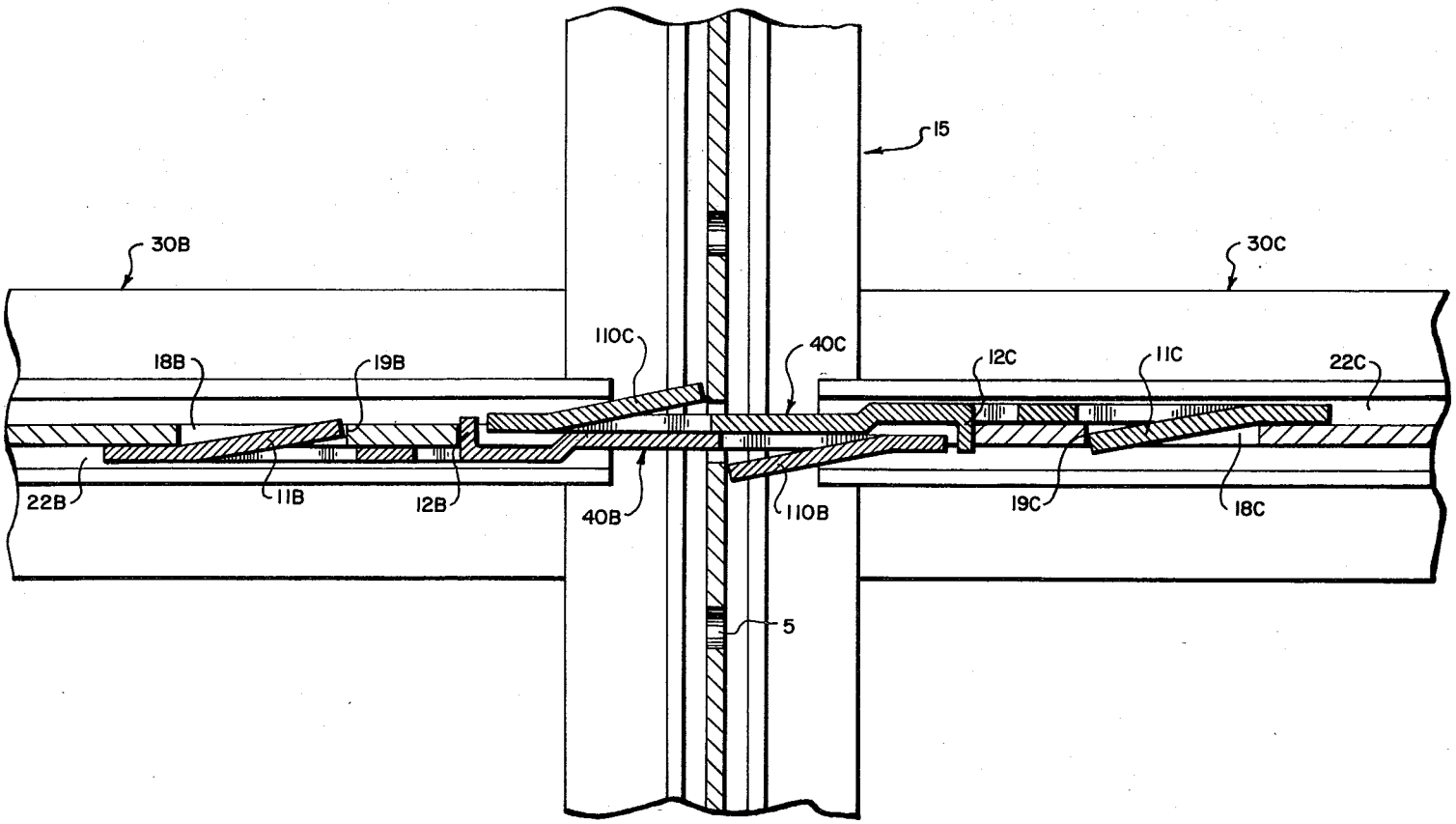
FIG. 5 is a cross section taken along line 5—5 in FIG. 4.

FIGS. 3, 4 and 5 illustrate a clip arrangement whereby cross tees 30B and 30C are joined to main tee 15. The major new elements illustrated in this exploded view include recesses 31B and 31C in cross tees 30B and 30C, respectfully, clips 40B and 40C and slot 60 in main tee 15. The connection of an individual cross tee, rail 30B, to the main tee will first be discussed, referring to FIG. 3. The cross tee end of clip 40B operates in a manner substantially identical to that described above for the splice clip 10 of FIGS. 1 and 2 where a clip in accordance with the invention was used to connect mutually abutting rails 15 and 15A. Here this end of the clip, now clip 40B, registers into grooves 21B and 22B of rail 30B. Similarly the clip 40B slides into registration with rail 30B until detent finger 11B engages retainer 19B. It is again preferred that a tab, such as tab 12B, limit the depth of clip registration. Held within the grooves and secure against both withdrawal and further insertion, clip 40B is securely attached to cross tee 30B.

That end of clip 40B which extends from its attachment to rail 30B narrows to a reduced width appropriate to pierce, but not sever, web 16 of the main tee 15 at vertical slit 60. When clip 40B is fully inserted into slit 60, detent finger 110B engages against the opposite side of web 16 in rail 15 to secure the attachment of rail 15 to clip 40B and thereby to rail 30B.

Slit 60 has two important features with respect to clip 42B. The first is the narrowed channels 61 at the upper and lower extremities of the vertical slit and second, indentation 62B which widens the passage at the middle region of slit 60. Indentation 62B allows detent finger 110B an easier installation by minimizing excessive compression and thereby decreasing resistance to insertion. Inserted detent finger 110B is secure despite this widening because channels 61 sufficiently restrict the lateral freedom of clip 110B with slit 60 that the detent finger is not subject to accidental disengagement. This arrangement is secure even when, as illustrated, channels 61 are wide enough to receive the passage of two clips.

In addition, the illustration of slit 60 shows indentation 62C opposite indentation 62B. This arrangement allows clip 40B to attach to either side of rail 30B, if grooves are present, and still be received into slit 60. Further, widening slit 60 to establish both indentations, in conjunction with sufficiently wide channels 61, allows the attachment of cross tees on both sides of main tee 15, as discussed below.

Further refinements of the clipping arrangement illustrated in FIG. 3 should be noted. Each of these facilitates coaxial attachment of bilaterally symmetrical, identical cross tees 30B and 30C on either side of main tee 15. First, the main tee end of clip 40B is offset inwardly to bring this extension to and adjacent one side of the plane which vertically and longitudinally bisects web 16B. The coaxial attachment of cross tees 30B and 30C requires that the plane which vertically bisects web 16B similarly bisects web 16C of rail 30C once both are attached to the main tee. Rail 30C is attached to rail 15 by clip 40C opposite rail 30B. Clip 40C registers into rail 30C adjacent web 16C and is there rigidly affixed by the interaction of grooves 21C and 22C, detent finger 11C, retainer 19C, and tab 12C, all operating in a manner similar to the attachment of clip 40B to rail 30B. The other end of clip 40C extends from rail 30C and is offset to bring the face of the clip to and immediately adjacent that vertical plane which longitudinally bisects web 16C. This extension of clip 40C is narrowed to pierce web 16 of rail 15 at the same slit 60 which clip 40B pierces. Detent finger 110C of clip 40C engages the distal face of web 16 once the clip has been fully inserted into slit 60.

Though the method of attachment is identical, it should be noted that the attachment of clip 40C is not a mirror image of the attachment of clip 40B, rather the clips must register on opposite sides of their respective cross tees. In this manner the main tee ends of clips 40B and 40C meet along the central longitudinal axis of rails 30B and 30C where they pass through slit 60 which is widened to receive both as they pass, in contact, going opposite directions. Each clip is braced against the other, secured within the slit, and locked against withdrawal by a detent finger sprung outwardly to engage the web 16 of the main tee adjacent slit 60.

The main tee end of the clips come adjacent the cross tee coaxial axis, pass through the slit in mutual contact, extend through the other side of web 16 where the detent finger engages that web and extend somewhat further, still adjacent the coaxial axis. It is this last portion of the clip, that portion beyond the engaged detent finger, that fits into recesses 31B and 31C of the respective opposite cross tees. This recess is required because the extension proceeds at the axis and is beneficial in that a tight fit of the clip extension to the recess imparts additional stability to the joint. Thus cross tee 30B requires hole 18B, recess 31B and, in the preferred embodiment, benefits from a slight indentation of lower flange 17B to allow web 16B to rest on the lower flange 17 of the main tee.

Again, as with splice clip 10, either end of clips 40B or 40C may be affixed to its respective rail by other means and still retain many benefits provided by the means of connection described above. For example, clips can be bolted to one of the rails when that rail is in an easily accessable position and thereafter, overhead assembly proceeds with the same singular horizontal motion.

Reference to FIGS. 4 and 5 will aid in understanding the assembly of the members illustrated in the exploded view of FIG. 3. FIG. 4 is a cut away view of the connected assembly of cross tees coaxially joined through the main tee and FIG. 5 is a sectional view of the engaged clips and rails.

From the foregoing it can be seen that once the primary rails have been suspended in place, these and additional rails are easily connected by clips in order to establish a grid framework into which ceiling fixtures are set. Each connection requires only horizontal motions and abutting rail-to-clip-to-abutted rail connection proceeds quickly without requiring any overhead operation more difficult than alignment of the clip and rail and pushing them into engagement.

I claim:

1. In a connection system for connecting axially aligned cross tees to opposite sides of a central main tee during the assembly of grid framework for a suspended ceiling system, the apparatus comprising:

said cross tee rails, herein designated first and second cross tees, each having a web, a flange, an abutting end to be connected to said main tee and a recess in that abutting end;

said main tee rail having a flange, a web and a vertical slit through said web portion;

a first clip comprising:

a cross tee end connectable to said first cross tee; a main tee end receivable through said slit and connectable to said main tee, said main tee end further comprising:

a substantially planar inside surface which, upon assembly, is horizontally offset from the first cross tee to extend therefrom immediately adjacent a first side of the axial center line of the aligned cross tee webs; and a detent finger extending from said clip and sloping outwardly away from said inside surface and toward the cross tee end of the clip;

a second clip comprising:

a cross tee end connectable to said second cross tee;

a main tee end connectable to said main tee and receivable through said slit simultaneously with the passage of the first clip through said slit, said main tee end further comprising:

a substantially planar inside surface which, upon assembly, is horizontally offset from the second cross tee to extend therefrom immediately adjacent a second side, opposite said first side, of the concurrent axial center lines of the aligned cross tee webs;

a detent finger, said detent finger extending from said clip and sloping outwardly away from said inside surface and toward the cross tee end of said clip;

whereby, upon assembly, the main tee end of the first clip extends through a slit in the main tee where the detent finger of said first clip engages the distal side of the main tee web adjacent the slit and the extension of the clip beyong the slit is snugly received into a recess in the abutting end of the second cross tee from which the main tee end of a second clip projects, passing through the same slit in contact with the first clip and engages the distal side of the main tee with a detent finger, and with the extension of the clip from the second cross tee extending beyond the slit being snugly received into a recess in the abutting end of the first cross tee;

whereby, the first clip, the second clip and the slit cooperate in a manner resistant to torsion applied through said cross tees and further whereby reception of the extension of said first clip into a recess of the second cross tee and the corresponding reception of the extension of said second clip into a recess of the first cross tee cooperate in a manner resistant to a bending moment applied in the vertical plane between the pair of abutting rails.

2. Apparatus in accordance with claim 1 in which said clips are connected to each of said cross tees, by means comprising:

a pair of vertically disposed axial grooves positioned adjacent the web of said cross tees;

a spring biased detent finger on said cross tee end of the clip, said detent finger extending from the face of said clip such that it is biased toward the web of said cross tee when the clip is registered into said grooves for assembly; and said cross tee web having a retaining surface adapted to engage the detent finger on the cross tee end of said clip in order to secure the clip against longitudinally sliding out of reception within said grooves.

3. Apparatus in accordance with claim 1 in which a tab projects from the face of said clip, near the center thereof, said tab being engageable against a surface of one of said cross tees, whereby the depth that said clip will, upon insertion, register into said grooves is limited.

4. In a suspended ceiling system used for supporting ceiling tiles and other fixtures within a grid framework suspended beneath the major structural elements in a building, the connecting apparatus comprising:

a plurality of rails having a vertical web and flange beneath said web, said web, said rails including an abutting rail and an abutted rail, said abutting rail being connectable at its end to said abutted rail of the grid framework;

at least said abutting rail having a pair of vertically disposed axial grooves positioned adjacent its web;

a clip having a first end adapted for attachment to said abutted rail, and a second end having a substantially planar face founded on opposite sides by parallel edges slidably receivable into said grooves of said abutting rail, and a spring biased detent finger on said second end, said detent finger extending from the face of said clip such that it is biased toward the web of said abutting rail when the clip is registered into said grooves for assembly;

said abutting rail web having a retaining surface adapted to engage said detent finger to secure the clip against longitudinally sliding out of reception within said grooves;

a tab extending from said clip to be engagable with one of said rails to limit the depth that said clip engages that rail; and recessed notches defined by the adjoining surfaces of each the abutting rail and the abutted rail whereby, upon assembly, both said notches fit tightly about said tab which thereby acts as a key resistant to shear stresses applied between said rails.

5. In a connection system for connecting axially aligned main tees within a grid framework for a suspended ceiling system, the apparatus comprising:

a pair of main tee rails, herein designated first and second main tees, which are to be connected in axial alignment, each rail comprising:

a web portion; and a flange;

said second main tee further comprising;

a pair of longitudinal grooves established immediately adjacent the web of said second main tee; and a detent finger retaining surface associated with the web of said second main tee;

a clip comprising:

a first end connectable to said first main tee;

a second end connectable to said second main tee, said second end comprising:

a planar section having opposite parallel edges that are receivable into said longitudinal grooves; and a spring biased detent finger whereby, upon assembly, said detent finger engages said detent finger retaining surface in order to prevent the axial withdrawal of said clip from said grooves;

said second main tee having a surface which, upon assembly, is in direct or indirect compressive contact with said first main tee in order to prevent the further insertion of said clip into said grooves; and a tab extending from said clip to be engaged with one of said rails to limit the depth that said clip engages that rail;

recessed notches defined by the surfaces of said first and second main tees which, upon assembly, engage in compressive contact whereby, upon assembly, both said notches fit tightly about said tab which thereby acts as a key resistant to shear stresses applied between said rails.

6. Apparatus in accordance with claim 5 in which said detent finger is a leaf spring formed from a cantilevered extension from the interior of the planar face of said clip.

7. Apparatus in accordance with claim 5 in which said retaining surface for receiving said detent finger is the edge of an aperture formed in the web of the grooved clip receiving rail.

8. In a suspended ceiling system used for supporting ceiling tiles and other fixtures within a grid framework suspended beneath the major structural elements in a building, the connecting apparatus comprising:

a plurality of rails having a vertical web and a flange beneath said web, said plurality of rails including first and second abutting rails and an abutted rail, said first and second abutting rails each being connectable at one end to opposing sides of said abutted rail of the grid framework, both said first and second abutting rails being connectable coaxially to each other and at an angle to the abutted rail;

said first and second abutting rails each having a pair of vertically disposed axial grooves defined by channels connected to said web and positioned separate from said flange on said abutting rail;

a slit through the web of said abutted rail;

a duality of clips, each clip having a first end having a first spring biased detent finger receivable through said slit for attachment to said abutted rail, and a second end having a substantially planar face bounded on opposite sides by parallel edges slidably receivable into said grooves of said abutting rail, and a second spring biased detent finger on said second end, said second detent finger extending from the face of said clip such that it is biased toward the web of said abutting rail when the clip is registered into said grooves for assembly;

a first retaining surface presented for each said first detent finger, said first retaining surface engagable with said second detent finger;

a second retaining surface presented for each said second detent finger, said second retaining surface located on each said abutting rail web and adapted to engage said second detent finger to secure the clip against longitudinally sliding out of reception within said grooves;

a horizontal offset in each of said clips whereby, upon assembly, said first end of each clip is brought into alignment immediately adjacent that plane which longitudinally bisects the webs of both said coaxially aligned abutting rails;

said slit being vertically oriented and of sufficient breadth to allow two clips to pass through, whereby, both said clips are received through said slit from opposite directions and there pass each other in contact at that plane which bisects the web of both said abutting rails; and a recess in the end of each abutting rail which, upon assembly, receives the extension of the opposite clip in a manner resistant to a bending moment supplied in the vertical plane between the pair of abutting rails; whereby, upon assembly, each clip cooperates with the other in order to secure a pair of abutting rails in coaxial alignment about a mutally abutted rail.

9. In a connection system for connecting axially aligned main tees within a grid framework for a suspended ceiling system, the apparatus comprising:

a pair of main tee rails, herein designated first and second main tees, which are to be connected in axial alignment, each rail comprising:
a web portion; and
a flange;
said second main tee further comprising;
a pair of longitudinal grooves defined by channels connected to said web and positioned separately from said flange; and
a detent finger retaining surface associated with the web of said second main tee;
a clip comprising:
a first end connectable to said first main tee;
a second end connectable to said second main tee, said second end comprising:
a planar section having opposite parallel edges that are receivable into said longitudinal grooves; and
a spring biased detent finger whereby, upon assembly, said detent finger engages said detent finger retaining surface in order to prevent the axial withdrawal of said clip from said grooves;
a tab extending from said clip engagable with one of said rails to limit the depth that said clip engages that rail;
an engaging surface on said second main tee which; upon assembly, is in direct or indirect compressive contact with an engaging surface on said first main tee in order to prevent the further insertion of said clip into said grooves; and
recessed notches defined by the engaging surfaces of said first and second main tees which, upon assembly, engage in compressive contact whereby, upon assembly, both said notches fit tightly about said tab which thereby acts as a key resistant to shear stresses applied between said rails.

* * * * *